United States Patent [19]

Schubeis

[11] 4,100,646

[45] Jul. 18, 1978

[54] SELF-CLOSING HINGE

[76] Inventor: Ewald Ingemar Emanuel Schubeis, Tegnérgatan 9, S-111 40 Stockholm, Sweden

[21] Appl. No.: 772,740

[22] Filed: Feb. 28, 1977

[51] Int. Cl.[2] ..... E05F 3/20; E05D 11/02

[52] U.S. Cl. ..... 16/54; 16/68; 16/161; 16/186

[58] Field of Search ..... 16/155, 51, 52, 54, 16/68, 161, 186

[56] References Cited

U.S. PATENT DOCUMENTS

| | | | |
|---|---|---|---|
| 693,588 | 2/1902 | Cliff | 16/54 |
| 1,103,792 | 7/1914 | Marksch | 16/54 |
| 2,015,988 | 10/1935 | Bommer | 16/54 |
| 2,538,679 | 1/1951 | Foltis | 16/68 |
| 2,591,476 | 4/1952 | Swanson | 16/54 |

FOREIGN PATENT DOCUMENTS

| | | | |
|---|---|---|---|
| 757,293 | 10/1933 | France | 16/186 |

*Primary Examiner*—James Kee Chi

*Attorney, Agent, or Firm*—Cushman, Darby & Cushman

[57] ABSTRACT

A self-closing hinge is described which comprises two hinge members intended to be secured to a door or the like and to a door frame, respectively, one of the hinge members having a cylindrical sleeve closed at the lower end and the other member having a hinge bolt turnably accommodated in said sleeve in order swingably to connect said hinge members. Said sleeve has a portion at its closed lower end provided with an internal thread, particularly a multiple thread of comparatively great pitch, said internal thread being arranged to coact with a corresponding external thread of a ring member in which the lower end portion of said hinge bolt is non-rotatably but axially displaceably journalled whereby said ring member, upon relative rotation in one direction between said hinge bolt and said sleeve, is screwed a distance upward in said sleeve to engage with an annular shoulder on said hinge bolt and upon continued relative rotation is screwed further upwards, thereby lifting said hinge bolt.

7 Claims, 1 Drawing Figure

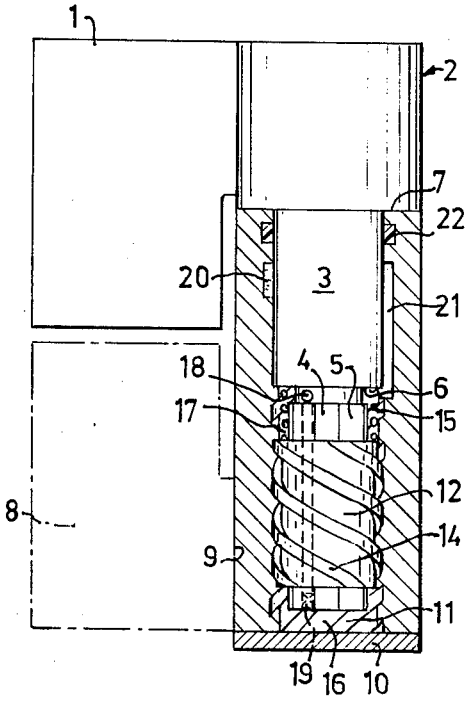
1
2
7
22
20
3
21
18
4
5
6
17
15
12
8
14
9
11
19
16
10

SELF-CLOSING HINGE

The present invention relates to a hinge of the type which comprises two hinge members attachable to a door or the like and to a door frame, respectively, said hinge members being swingably interconnected by means of a cylindrical sleeve and a hinge bolt pivotably accommodated in said sleeve.

It is often desirable for a door, after having been opened, automatically to return to a closed position. This is especially the case with fire-proof doors. For this purpose so-called door closers are commonly used which exert a force on the open door and swing the same into a closed position. Such door closers, however, are comparatively expensive and bulky. It is also previously known to design a door hinge in such a manner that the door is lifted a short distance when it is swung open, for instance by means of slanting surfaces gliding against each other, whereafter the weight of the door exerts a downwardly directed force urging the door to descend again and thereby be swung back into its closed position. However, the last-mentioned principle for self-closing hinges suffers from the disadvantage that lifting of the door commences as soon as the door is swung open from its closed position. The top edge of the door is thereby pressed against the lintel of the door frame and the lifting movement is arrested. To allow the door to be swung open it is therefore necessary either to provide a comparatively wide gap between the top edge thereof and the lintel of the door frame, or to bevel said door edge and the lintel.

The main object of the present invention is to provide a self-closing hinge of the type mentioned which does not lift the door upwards until the door has been swung to a predetermined angle out of the closed position.

An embodiment of the invention will now be described while referring to the accompanying drawing, which shows schematically a self-closing hinge according to the invention in elevation and partly in axial section.

The hinge comprises an upper hinge member 1 intended to be attached to the door. The upper hinge member is formed integral with or rigidly mounted to a hinge bolt 2 which in the mounted position of the hinge depends vertically from said hinge member 1. The hinge bolt is provided with an upper cylindrical portion 3 and a lower end portion 4 having smaller diameter than said upper cylindrical portion 3 and being provided with at least one axially extending key 5. An annular shoulder 6 is formed between said cylindrical portion 3 and said end portion 4, and a second annular shoulder 7 is preferably arranged at the upper end of said cylindrical portion 3.

A lower hinge member 8, which is to be attached to a door frame, is formed integral with or rigidly connected to a sleeve 9 the axis of which is vertical when the hinge is mounted. The bottom end of the sleeve 9 is closed by a disc 10 secured by means of screws or by welding. The bottom portion of said sleeve 9 is provided with a screw thread 11, preferably a multiple thread having a comparatively large pitch, whereas the top portion thereof is cylindrical and has a diameter somewhat greater than the root diameter of said thread 11. When the hinge is assembled the cylindrical portion 3 of the hinge bolt 2 is guided in the cylindrical portion of said sleeve 9 with a comparatively small play therebetween, while the end portion 4 of said bolt depends into the threaded bottom portion of said sleeve 9 at a radial distance therefrom.

A ring member 12 is provided in the annular space between the threaded portion 11 of the sleeve 9 and the end portion 4 of the hinge bolt 2. The ring member 12 has an external thread 14 corresponding to and meshing with the internal thread 11 of the sleeve 9 and the boring of the ring member is provided with an axial key groove for each key 5 of the bolt end portion 4. Said end portion 4 is thus nonrotatably but axially displaceably arranged in the ring member 12, the axial displacement in one direction being limited by abutment of the shoulder 6 of the hinge bolt 2 against the adjacent end surface of the ring member 12. If desired, the axial displacement in the opposite direction may be limited by means of a stop member (not shown) arranged at the outer end of said sleeve 9.

When the hinge according to the invention is mounted between a door and a door frame and the door is closed, said hinge bolt 2 extends so far into said sleeve 9 that its second annular shoulder 7 engages the top end surface of the sleeve 9, and the cylindrical portion 3 of the hinge bolt is guided in the cylindrical portion of said sleeve 9. In this position the ring member 12 is screwed so far down into the thread 11 of the sleeve 9 that the bottom end surface of the ring member is positioned a short distance above the closure disc 10, the top end surface of the ring member 12 thereby being situated at a predetermined distance below the annular shoulder 6 of the hinge bolt 2. When the door is opened the hinge bolt 2 is rotated relative to the sleeve 9 and, on account of the keys 5 and the key grooves in the ring member 12, said ring member partakes in the turning movement of the hinge bolt 2. Because of the thread engagement between the sleeve 9 and the ring member 12 the latter is screwed upwards in the sleeve. During the initial part of the door swinging movement only the ring member 12 is displaced upwards in the sleeve 9 and, thus, the door is not lifted. When the top end surface of the ring member 12 engages the annular shoulder 6 of the hinge bolt, said bolt 2 is displaced upwards together with the ring member 12 when the same is turned relatively to said sleeve 9 during continued swinging movement of the door and, thus, the door is also lifted. The distance of displacement of the ring member 12 into abutment against said annular shoulder 6 may easily be so chosen that the lifting of the door does not commence until the top edge of the door is free from the lintel of the door frame.

When the open door is released, the weight thereof exerts a downwardly directed force on the hinge bolt 2 and, since the annular shoulder 6 rests against the top end surface of the ring member 12, this axial force is transmitted to the ring member 12 and by means of the thread engagement it produces a turning movement of the ring member which thereby is screwed downwards into the sleeve 9 and turns the hinge bolt 2 over the key grooves and keys 5, whereby the door is swung back into its closed position. When the downward movement of the door is arrested through engagement of the second annular shoulder 7 of the hinge bolt 2 against the top edge of the sleeve 9, the door continues to swing on account of its inertia and, since the ring member 12 always follows the turning movement of the hinge bolt 2, the ring member 12 is screwed down into its original position at a distance from the shoulder 6.

In the embodiment shown, a helical compression spring 15 is arranged around the end portion of the hinge bolt 2 between the annular shoulder 6 thereof and the adjacent end surface of the ring member 12. The purpose of this compression spring 15, which may be left out, is to ascertain that the door is completely swung into its closed position, said spring working in the following manner. When the door is swung up the ring member 12, as previously mentioned, is first screwed upwards without displacement of the hinge bolt 2, and the compression spring 15 is thereby compressed. When said spring is completely compressed or when the tension thereof becomes equal to the weight of the door, the hinge bolt is lifted as previously described by means of the ring member 12 when said ring member is screwed upwards. When the descent of the hinge bolt upon an automatic closing movement of the door is arrested by engagement between the second annular shoulder 7 and the end surface of the sleeve 9 and the swinging movement of the door continues under the action of its inertia, the tension stored in said spring 15 acts downwards against the ring member 12 thereby contributing to the downwards screwing thereof into the sleeve and, thus, also to a complete closing of the door.

To prevent the door from bumping too heavily against the door frame when closing, a further development of the inventive idea includes measures to provide an oil damping. For this purpose two cavities are arranged in the sleeve 9, one 16 of which being situated at the bottom of the sleeve 9 and being defined at its top end by the lower end surface of the hinge bolt 2 and lower end surface of the ring member 12. The second cavity 17 is situated above said ring member 12 between the top end surface thereof and the annular shoulder 6 of the hinge bolt. Said two cavities 16, 17 enclose an amount of oil and are interconnected over the gaps between the threaded portions 11, 14 and between the end portion 4 of the hinge bolt and the ring member 12, respectively, and possibly also over one or more passages 18 in the wall of the sleeve 9 or in the end portion 4 of the hinge bolt 2. When the door is opened and the ring member 12 is screwed upwards along the still axially stationary hinge bolt 2, oil from the cavity 17 flows down into the cavity 16 through said two gaps and through said passages 18, if any. The oil in said cavity 16 forms an oil cushion and, when the hinge bolt 2 and ring member 12 upon the closing movement of the door are displaced downwardly into said sleeve 9, oil from said oil cushion in said cavity 16 is forced back into the cavity 17, thereby dampening the closing movement of the door.

The damping effect may be adjusted by controlling the flow rate of the oil between said cavities 16, 17. This can be done for example by choosing the size of said gaps and/or the viscosity of the oil in such a way that the desired damping effect is achieved.

If said cavities 16, 17 are interconnected by means of one or more passages 18, the flow rate may be controlled by means of valves in said passage or passages. Two such passages 18 may thereby be provided, one of said passages including a check valve enabling an unrestricted flow from the cavity 17 to the cavity 16 since damping then is not necessary, the other passage including a check valve enabling a restricted and preferably adjustable oil flow in the opposite direction.

It is also possible in one single passage 18 to provide a valve enabling unrestricted flow in said first-mentioned direction and a restricted, preferably adjustable flow in the last-mentioned direction. Valves of this type are generally known structural members and need not be further described. A valve of this type having the reference numeral 19 is schematically shown on the drawing.

During the initial upwardly directed movement of the ring member 12 along the axially stationary hinge bolt 2, the volume of the cavity 16 increases and the volume of the cavity 17 decreases by the same amount. When the ring member 12 engages the annular shoulder 6, the volume of the cavity 17 is very small and cannot therefore accommodate oil to an amount sufficient to compensate for the continued volume increase of the cavity 16 during the continued axial displacement of the hinge bolt 2 and the ring member 12. In order to maintain a sufficient amount of oil in the cavity 16, an annular groove 20 is provided in the wall of the cylindrical portion of the sleeve 9 and at least one axial groove extends between said annular groove 20 and said cavity 17. In the position of the hinge as shown on the drawing, the two cavities 16, 17, the axial groove or grooves 21 and the main part of the annular groove 20 are filled with oil. To prevent oil from seaping out between the cylindrical portion 3 of the hinge bolt 2 and the cooperating surface of the sleeve 9, a resilient sealing ring 22, which also serves as a piston ring, is recessed in a peripheral groove in the inner wall of said sleeve 9.

The embodiment described above and shown on the drawing must only be regarded as an example without limiting effect. Many modifications are feasible within the scope of the inventive concept as defined in the attached claims, and such modifications should also be included in the requested patent protection.

What I claim is:

1. A hinge for supporting a door and the like in a frame therefore in such a manner that the hinge lifts the door vertically upwards, when the door is swung out of the frame and upon release of the door automatically swings the door back into the frame under the action of the weight of the door, said hinge comprising a first and a second hinge member adapted to be secured to said door and said frame, respectively, said first hinge member including a hinge bolt and said second hinge member including a sleeve comprising an upper cylindrical portion in which said hinge bolt is rotatably and axially displaceably journalled and a portion at its lower end provided with an internal thread, a ring member in the lower portion of said sleeve, said ring member having an external thread cooperating with the thread in said sleeve, said hinge bolt having a lower end portion journalled in a non-rotatable but axially displaceable manner in said ring member and said hinge bolt having a downwardly facing annular shoulder located within said sleeve and above said lower portion of said hinge bolt, the arrangement being such that said ring member upon initial relative rotation between said hinge bolt and said sleeve in a door-opening direction is freely screwed a distance upwards in said sleeve without engaging said annular shoulder on said hinge bolt and upon continued relative rotation engages said shoulder on said hinge bolt and thereby lifts same together with the door.

2. A hinge as in claim 1 including a helical compression spring arranged around said lower end portion of the hinge bolt, the ends of said spring engaging said annular shoulder of said hinge bolt and the adjacent end surface of said ring member.

3. A hinge as in claim 1 wherein a cavity is provided in said sleeve at each end of said ring member, said cavities being interconnected at least through the gap between said internal thread of said sleeve and said external thread of said ring member and the gap between said ring member and said hinge bolt, said cavities enclosing oil which is displaceable from one cavity to the other during the movement of the ring member in said sleeve.

4. A hinge as in claim 3 wherein the rate of flow of oil between said cavities is controllable at least in one direction.

5. A hinge as in claim 4 wherein the rate of oil flow between said cavities is controllable by choosing the sizes of said gaps.

6. A hinge as in claim 4 wherein the rate of oil flow between said cavities is controllable by choosing the viscosity of the oil.

7. A hinge as in claim 4 wherein said cavities, apart from said gaps, are interconnected through at least one passage in said sleeve and said hinge bolt, the rate of flow of oil between said cavities being controllable by valve means in said passages, said valve means allowing unrestricted oil flow in one direction and restricted oil flow in the opposite direction.

* * * * *